US006189673B1

(12) United States Patent
Lee

(10) Patent No.: US 6,189,673 B1
(45) Date of Patent: Feb. 20, 2001

(54) FLOOR FOR PASSENGER CONVEYOR

(75) Inventor: Jung Woo Lee, Kyoungsangnam-Do (KR)

(73) Assignee: LG Industrial Systems Co., Ltd., Seoul (KR)

( * ) Notice: Under 35 U.S.C. 154(b), the term of this patent shall be extended for 0 days.

(21) Appl. No.: 09/255,785

(22) Filed: Feb. 23, 1999

(30) Foreign Application Priority Data

Feb. 28, 1998 (KR) ..... 98-6642

(51) Int. Cl.[7] ..... B66B 29/08
(52) U.S. Cl. ..... 198/325; 198/324; 49/324
(58) Field of Search ..... 198/324, 325; 49/324

(56) References Cited

U.S. PATENT DOCUMENTS

| | | | | |
|---|---|---|---|---|
| 4,260,318 | | 4/1981 | Holritz et al. | 414/589 |
| 4,411,352 | | 10/1983 | Kettle | 198/328 |
| 4,682,681 | * | 7/1987 | Teranishi et al. | 198/333 |
| 5,291,982 | * | 3/1994 | Saito et al. | 198/325 |
| 5,332,077 | * | 7/1994 | Ogimura | 198/333 |
| 5,628,391 | * | 5/1997 | Volkening et al. | 198/325 |
| 5,851,050 | * | 12/1998 | Squire et al. | 296/146.4 |

* cited by examiner

*Primary Examiner*—Christopher P. Ellis
*Assistant Examiner*—Rashmi Sharma

(57) ABSTRACT

The present invention is directed to a floor for a passenger conveyor which includes floor rollers mounted below the floor, floor roller guide rails mounted upon a machine room for guiding the rollers, and a lift mounted in the machine room to be in contact with a bottom of the floor, wherein the floor can be easily opened and closed by one person without any other instrument in repair or maintenance, and wherein it is not needed to move the floor to another place after opening because the floor can stand upright in its place after opening the floor, so improving efficiency of working.

15 Claims, 11 Drawing Sheets

FLOOR FOR PASSENGER CONVEYOR

BACKGROUND OF THE INVENTION

1. Field of the Invention

The present invention relates to a floor used in escalators and passenger conveyors (hereinafter, referred to passenger conveyor as a general term), in particular to a floor for a passenger conveyor having a lift in a machine room for easily opening and closing the floor.

2. Description of the Prior Art

A passenger conveyor is generally mounted inclined between stories or mounted horizontally for carrying passengers continuously.

As shown in FIG. 1, the passenger conveyor includes balustrades 10, a step unit 20 for carrying passengers, and a machine room 30 receiving a driving machine for driving the step unit 20.

The step unit 20 includes a plurality of steps 21 for providing space of passengers to stand thereon, and a step chain 22 for connecting each of the steps 21. Though not shown in the figure, a guide rail is mounted in the passenger conveyor for guiding the steps 21.

The machine room 30 includes a motor 31 for providing rotating torque with use of electric power and a reducer 32 for amplifying the rotating torque of the motor 31 and reducing the rotating velocity of the motor 31. In addition, a driving shaft 33 is connected to the step chain 22 in parallel with an axis of the reducer 32 in order to receive driving force from the axis of the reducer 32 through a driving chain 34. By using the driving force transmitted to the driving shaft 33, a driving terminal gear 35 drives the steps 21.

Therefore, the driving force generated by the motor 31 in the machine room 30 is transmitted to the reducer 32, and the rotating torque reduced by the reducer 32 is then transmitted to the driving shaft 33 through the driving chain 34. Then, in accordance with rotation of the driving shaft 33, the driving terminal gear 35 drives the steps 21 with rotating in engagement with the step chain 22, so that the steps 21 may circulate.

The balustrade 10 includes panels 11 mounted in both sides of the steps 21 for serving as a side wall, and hand rails 12 mounted on the panels 11 for circulating along a regular path. When passengers moves on the steps 21, the hand rail 12 serves as a grip for a passenger to take hold of, so moving correspondingly in same speed as the steps 21 for ensuring passengers safety.

Floors F are mounted in starting and ending position of the steps 21 where passengers get on or off. Referring to FIG. 1 and FIG. 2, it can be shown that the floor F is mounted upon the machine room 30 provided in both ends of the passenger conveyor. The floor F serves as a footing extended from the steps 21 when passengers get on or off, and in addition serves as a cover of the machine room 30. Therefore, the floor F can be detached from the machine room 30 in case of repair or maintenance of devices in the machine room 30.

The floor F is assembled with two or three plates, made of steel or aluminum, so having about 25 kg in weight. The floor F is fixed on an upper portion of the machine room and positioned in same height as surroundings such that passengers should not stumble at the floor F when boarding on the passenger conveyor.

FIG. 3 is a cross-section side view showing the floor F mounted in the passenger conveyor according to the conventional art. As shown in the figure, the floor F includes a cover plate 36 which can be opened, and a base plate 37 disposed on the upper portion of the machine room 30 for fixing and supporting the cover plate 36. The cover plate 36 is firmly fixed to the base plate 37 by a connecting device such as a bolt in operation of the passenger conveyor. However, when it is needed to enter the machine room in order to repair any malfunction therein, the floor F can be opened by removing the bolt, inserting a bolt-shaped instrument into a bolt hole, and pulling the cover plate 36 with use of the bolt-shaped instrument.

However, the conventional floor F is too heavy and large for one person to carry, which can be sometimes cause of any accident. In addition, when detaching the floor F from the passenger conveyor, the floor F should be kept in a suitable place and a safety fence should be installed around a working spot. Therefore, in case of repair or maintenance, a lot of working place is required, so decreasing efficiency of working.

Moreover, in order to open the floor F, a man should remove the bolt and insert the bolt-shaped instrument into the bolt hole, so taking much time and energy to separate the floor F.

SUMMARY OF THE INVENTION

Therefore, the present invention is invented to solve the above problems of the prior art. So, an object of the present invention is to provide a floor for passenger conveyors in which the floor can be easily opened and closed by only a person not requiring any other instruments in case of repair or maintenance, so enhancing efficiency of working.

Other object of the present invention is to provide a floor for passenger conveyors in which it is not needed to move the floor to another place after opening because the floor can stand upright in its place and to install a safety fence around a working spot in case of repair or maintenance, so improving efficiency of working.

The above objects of the present invention can be accomplished by providing a passenger conveyor comprising a plurality of steps for providing space for passenger to board on; floors disposed in starting and ending portions of the steps for serving as supports for the passengers getting on or off the steps; machine rooms disposed below the floors; lift means installed in the machine room to be in contact with a bottom of the floor for lifting the floor; floor rollers rotatably mounted in both side ends of a bottom of the floor; and floor roller guide rails mounted in both sides upon the machine room for guiding the floor rollers.

In the passenger conveyor of the present invention, the lift means can comprise a spool for supporting one end bottom of the floor; a spool guide mounted around the spool for guiding the spool vertically; a elastic member installed below the spool guide for providing elastic force such that the spool moves upward; and a locking pin pivotably mounted in an upper and outer position of the spool guide, the locking pin being rotatable to a locking position and a release position in order to locking or releasing the spool.

In the passenger conveyor of the present invention, the spool can also comprise a spool body having a predetermined length; a spring seat formed on an lower end of the spool body for supporting one end of the elastic member; an elastic bar integrated with the spool body and extended from the spring seat upwardly in parallel with the spool body; a latching protrusion protruding opposite to the spoon body from an upper end of the elastic bar; an elastic bar guide protrusion formed on a side of the spool body and protruding against the elastic bar for guiding and converting direction of the elastic bar when the elastic bar is pushed inward by the spool guide; and an upper limit protrusion protrusively formed at an upper portion of the spool body, a thickness of the upper limit protrusion gradually decreasing from top to bottom, the upper limit protrusion having a curved upper surface.

In the present invention, the spool guide can comprise a spool guide body for receiving the spool; a spring seat fitted into a lower end of the spool guide body; an upper limit protrusion guide channel formed at an upper outer circumference of the spool guide body for guiding and restricting movement of the upper limit protrusion; an inclined portion formed under the upper limit protrusion guide channel to be narrowed downwardly for guiding the latching protrusion of the spool to a direction; a latching protrusion guide channel extended vertically and downwardly under the inclined portion for guiding movement of the inclined latching protrusion; and a fixing hollow formed laterally at an lower end of the latching protrusion guide channel for interposing the latching protrusion of the spool therein by the restoring force of the elastic bar.

In the passenger conveyor of the present invention, the elastic member can is interposed between the spring seat of the spool and the spring seat of the spool guide for providing the elastic force against the spool.

In the passenger conveyor of the present invention, the locking pin can comprise a rotary axis rotatably fixed by a pivot; a first portion extending from the rotary axis toward the floor; and a second portion extending from the rotary axis toward the upper limit protrusion of the spool, the second portion of the locking pin being at a predetermined angle with the first portion.

The passenger conveyor further comprises a hook rotatably mounted at an upper side of the machine room for fixing the floor when opening the floor.

BRIEF DESCRIPTION OF THE DRAWINGS

These and other features, aspects, and advantages of the present invention will become better understood with regard to the following description, appended claims, and accompanying drawings, in which like components are referred to by like reference numerals. In the drawings:

FIGS. 6 and 7 show sequential opening operation of the floor according to the present invention, in which FIG. 6 is a perspective view showing that the floor is lifted by a lift mounted in a machine room, and FIG. 7 is a perspective view showing that the floor is completely opened after advancing along the guide rails;

DETAILED DESCRIPTION OF THE PREFERRED EMBODIMENT

Hereinafter, the present invention will be explained in detail with reference to the accompanying drawings.

Figure 1:
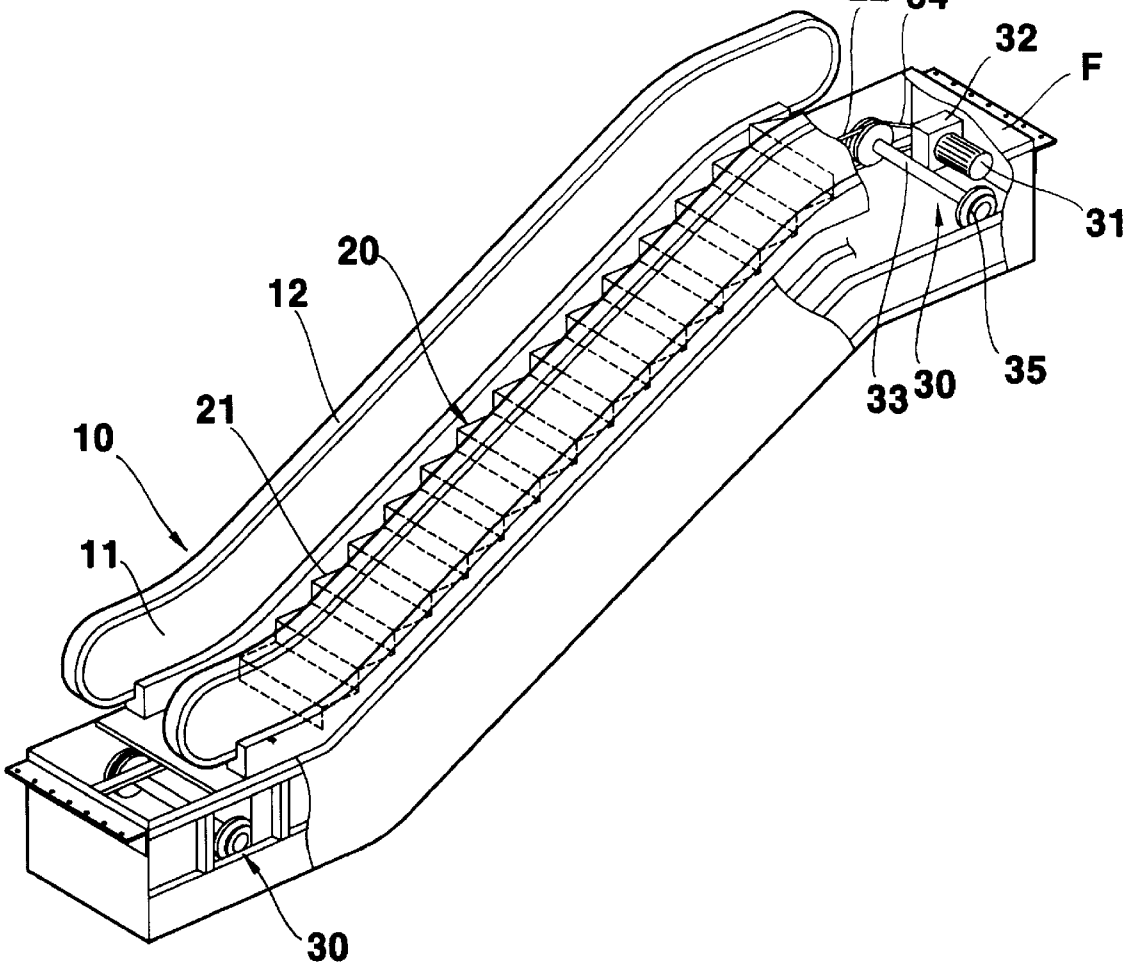
FIG. 1 (PRIOR ART)
FIG. 1 is a schematic view showing configuration of a general passenger conveyor.
Figure 2:
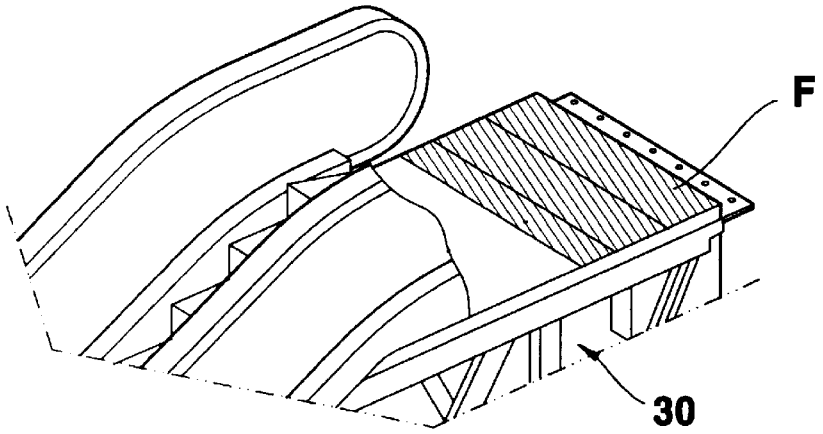
FIG. 2 (PRIOR ART)
FIG. 2 is a perspective view schematically showing a floor for a passenger conveyor according to the prior art.
Figure 3:
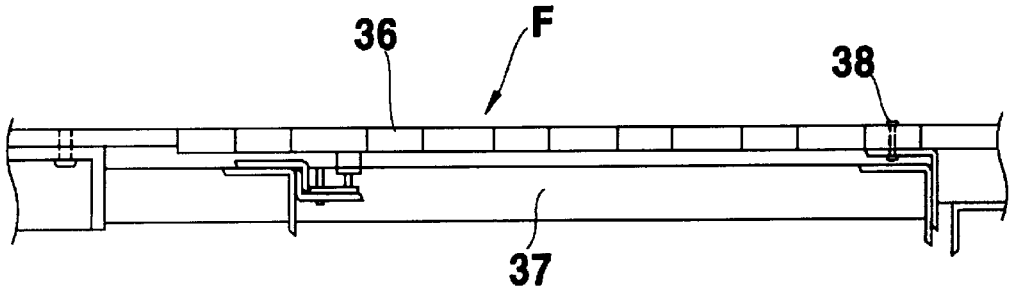
FIG. 3 (PRIOR ART)
FIG. 3 is a side section view showing the floor mounted in the passenger conveyor according to the prior art.
Figure 4:
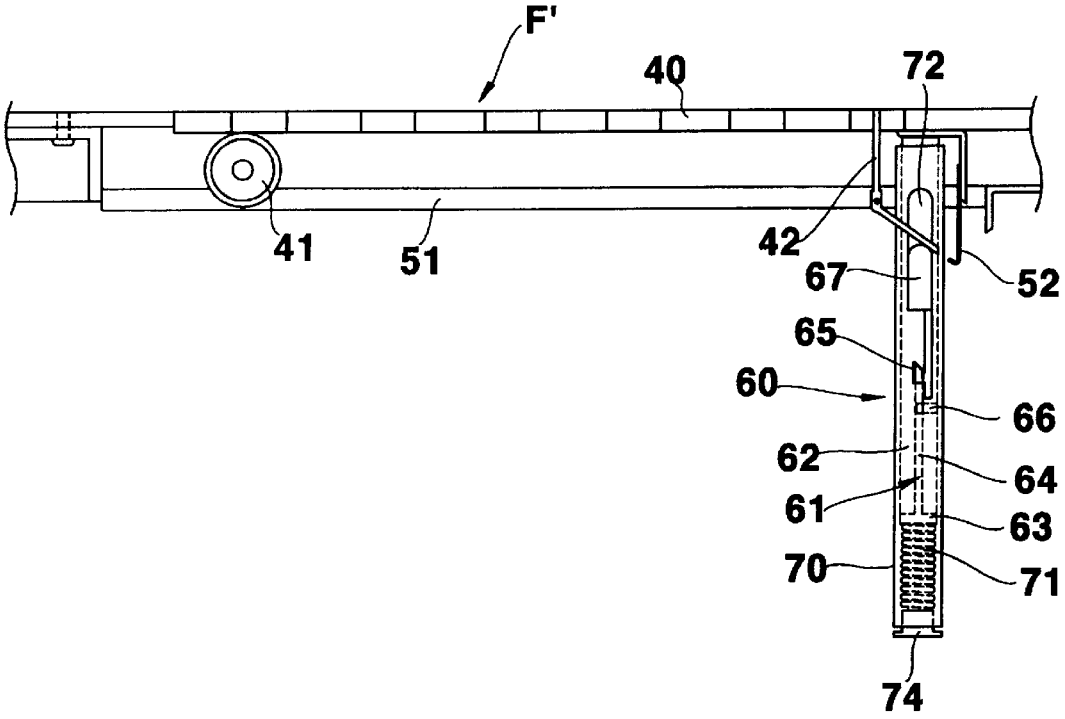
FIG. 4 is a side section view showing a floor for the passenger conveyor according to the present invention.
Figure 6:
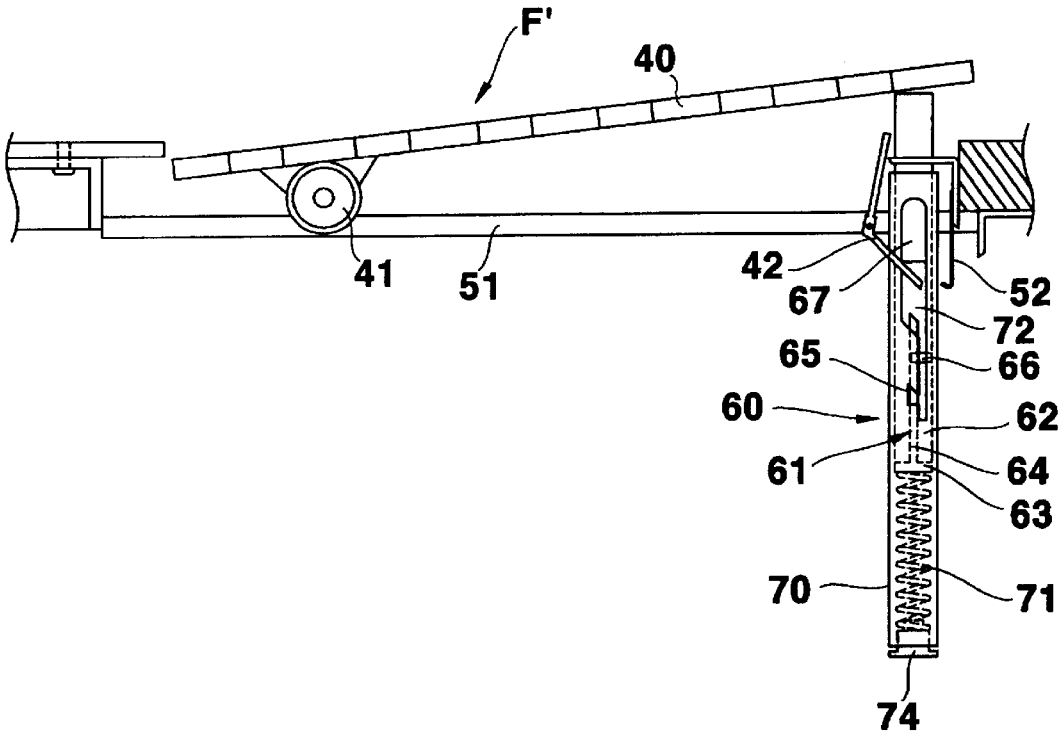
Figure 7:
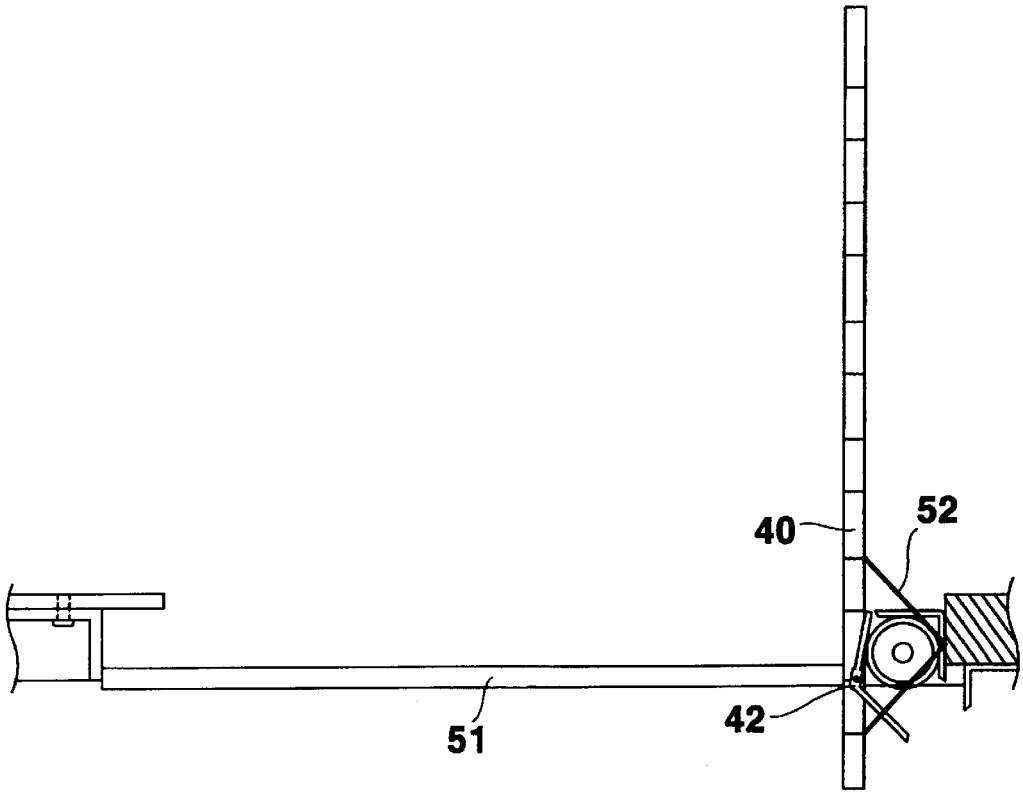
Figure 14:
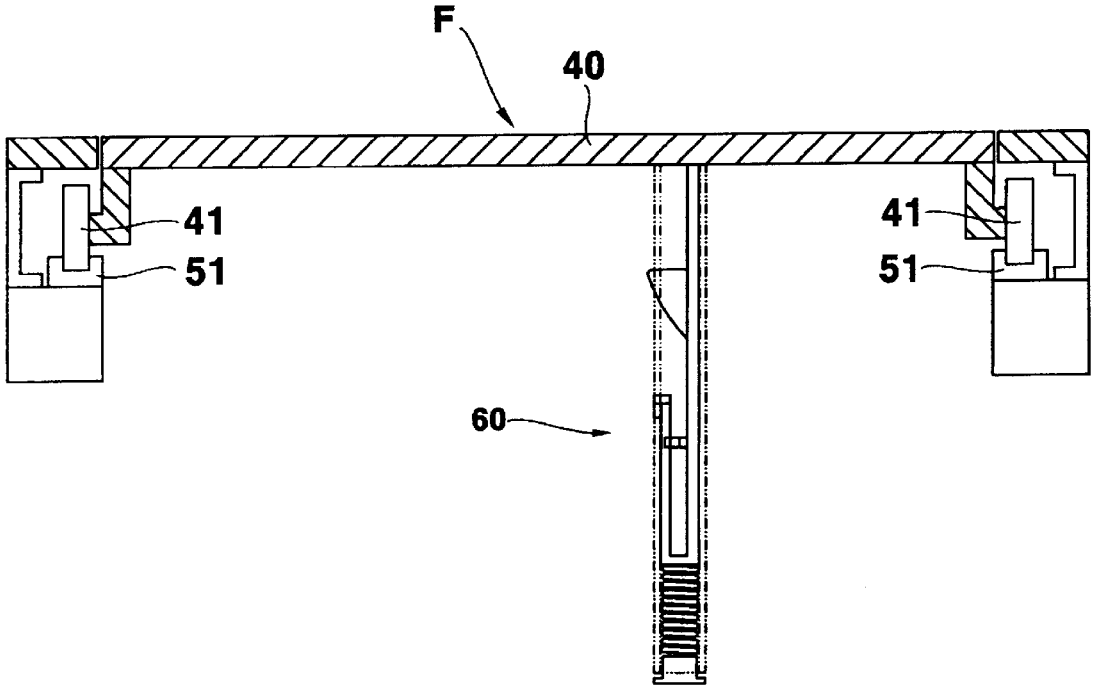
FIG. 14 shows a front view of the floor for the passenger conveyor according to the present invention.

FIG. 4 is a side section view showing a floor for a passenger conveyor according to the present invention. Also, FIG. 6 shows that one end of the floor is partly lifted and FIG. 7 shows that the floor is completely opened. Referring to the figures, the floor F' for the passenger conveyor according to the present invention includes a floor body plate 40 seated on the machine room 30 of the passenger conveyor. A pair of floor rollers 41 are mounted in both ends of the floor body plate 40 (see FIG. 14). The floor rollers 41 are biased from a center of the floor body plate 40 to one side. A pair of floor roller guide rails 51 are disposed on both sides of an upper position of the machine room 30 for guiding the floor rollers 41. A lift 60 is disposed in the machine room 30 for lifting one end of the floor body plate 40. One end surface of the lift 60 faces a bottom of the body plate 40 at a position opposite to the floor rollers 41. A hook 52 is mounted near the lift 60 in the machine room 30 for retaining the floor body plate 40 in a vertical status when the floor body plate 40 opens.

In addition, a locking pin 42 is formed in an upper and outer position of the lift 60. The locking pin 42 is pivotably fixed to the floor roller guide rail 51 and extended to two directions with a predetermined angle from the pivot, in which a first portion extends to the floor body plate 40, and a second portion extends to the lift 60.

Figure 5:
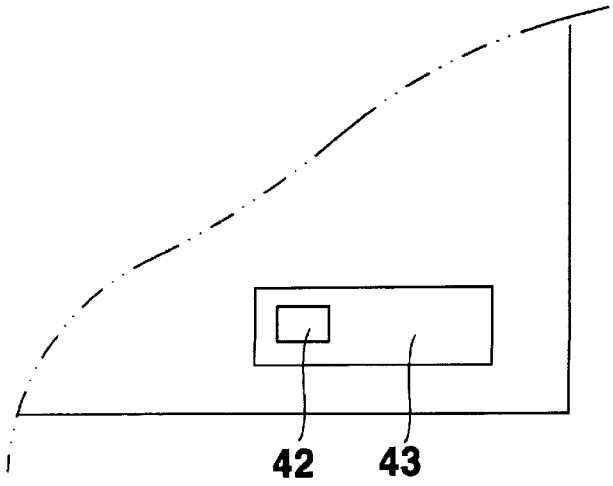
FIG. 5 is a plane view showing an opening manipulation unit formed in the floor for the passenger conveyor according to the present invention.

FIG. 5 is a plane view for partly showing the floor body plate for illustrating the opening manipulating unit of the floor which uses the locking pin 42. Referring to the figure, a perforating portion 43 is formed in the floor body plate 42 so that the first portion of the locking pin 42 toward the floor body plate 40 can be inserted into the perforating portion 43. An end of the first portion of the locking pin 42 is preferred to extend to a nearly same height as an outer surface of the floor body plate 40, while it is desirable for the end not to project out of the floor body plate 40. In addition, the first portion end of the locking pin 42 is located in one side (left in the figure) of the perforating portion, that is, a locking position when the floor F' is closed. When opening the floor F', the first portion end is moved to the other end (right in the figure), that is, a release position.

On the other hand, when the floor F' is closed, an end of the second portion of the locking pin 42 toward the lift is disposed upon top of an upper limit protrusion 67. However, when the first portion end is moved to the release position as described above, the second portion end escapes from the top of the upper limit protrusion 67 (see FIG. 6).

In addition, though not shown in the figures, the locking pin 42 includes a coil spring in a connecting portion to the guide rail 51, so providing the restoring force for the locking pin 42 to return to its original position when the floor F' is closed.

FIG. 8 to FIG. 12 show the lift 60 in detail. Referring to the figures, the lift 60 includes a spool 61 for supporting the one end bottom of the floor body plate 40, a spool guide 70 for guiding the spool 61 vertically, and a spring 71 mounted in the spool guide 70 for giving the elastic force in order to move the spool 61 upward.

Figure 8:
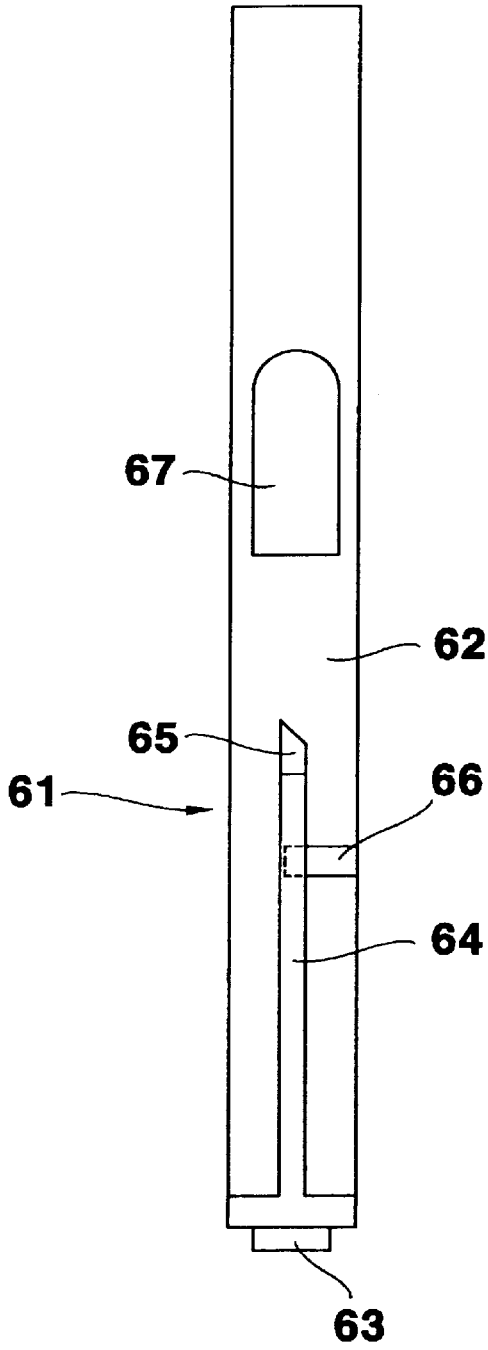
FIGS. 8 and 9 are front and side views showing configuration of a spool included in the lift of the present invention, respectively.
Figure 9:
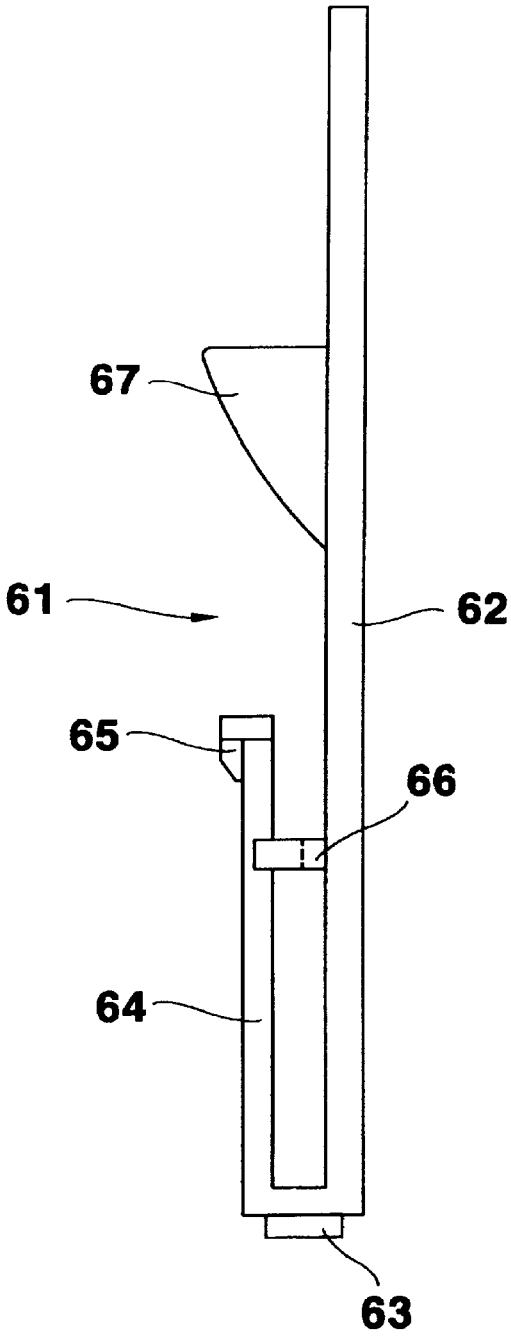

FIG. 8 and FIG. 9 are front and side views showing the spool included in the lift of the present invention, respectively. As shown in the figures, the spool 61 includes a body 62 having a predetermined length. On a lower end of the spool body 62, a spring seat 63 is formed for mounting one end of the spring 71. The spool 61 also includes an elastic bar 64, integrated with the spool body 62 and extended upward in parallel with the spool body 62. On an upper end of the elastic bar 64, a latching protrusion 65 is formed and protruded in an opposite direction to the spool body 62. A side surface of the latching protrusion 65 opposite to the spool body 62 is inclined inward. An elastic bar guide protrusion 66 is formed to the spool body 62 for converting direction of the elastic bar 64. The elastic bar guide protrusion 66 has an inclined side surface, so being disposed lower than the latching protrusion 65 such that the inclined side surface is positioned near the elastic bar 64. Therefore, when the elastic bar 64 moves downward by an external pressure, the latching protrusion 65 moves inward by the fixing hollow 73 of the spool guide 70, thus moving laterally along the inclined side surface of the elastic bar guide protrusion 66. The upper limit protrusion 67 is formed at and protruded from an upper portion of the body 62 of the spool 61. A thickness of the upper limit protrusion 67 gradually decreases from top to bottom, while the upper limit protrusion 67 having a curved upper surface. The upper limit protrusion 67 restricts the spool body 62 to rise to a predetermined height along the spool guide 70.

Figure 10:
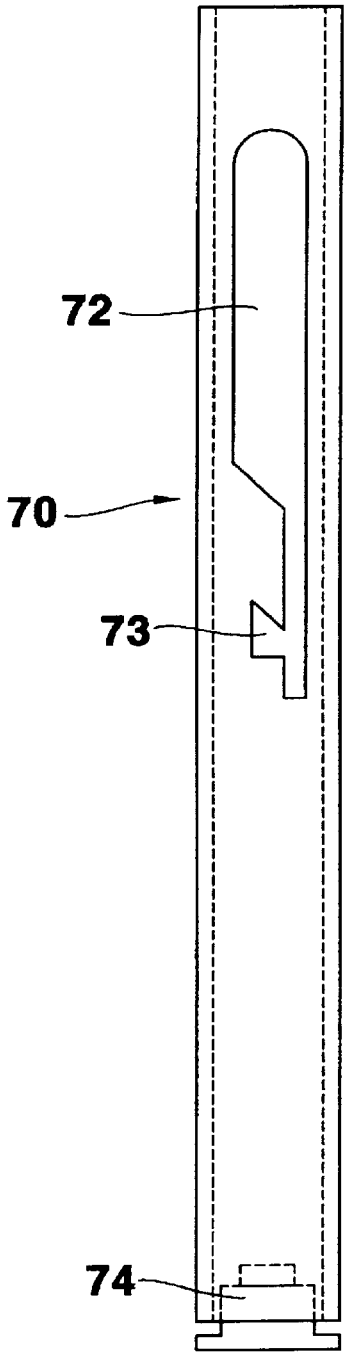
FIG. 10 is a front view showing a spool guide of the lift according to the present invention.
Figure 11:
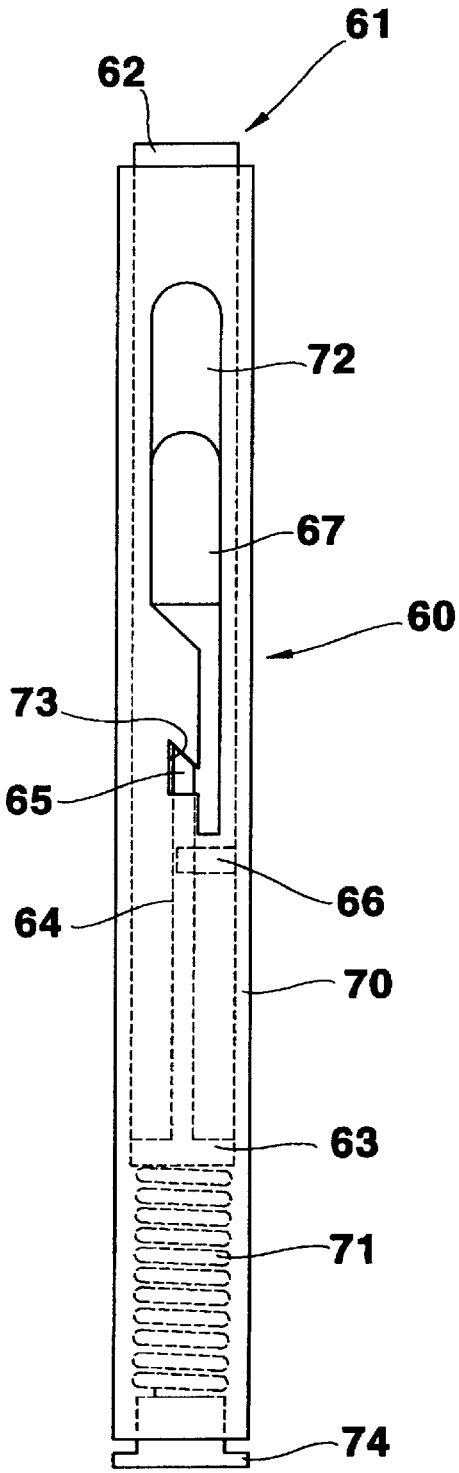
FIG. 11 is a front view showing that a latching protrusion of the spool is latched on a fixing hollow of the spool guide.

Referring to FIG. 10, the spool guide of the lift according to the present invention is illustrated. The spool guide 70 has a pipe shape (dotted line in the figure) for receiving the spool 61. A spring seat 74 is united under the spool guide 70 for supporting the spring 71. A guide channel 72 is formed vertically on an outer circumference of the guide spool guide 70 in its upper portion for guiding and restricting movement of the spool 61.

As shown in the figure, the guide channel 72 consists of an upper limit protrusion guide channel, an inclined portion, a latching protrusion guide channel, and the fixing hollow 73. The upper limit protrusion guide channel guides and restricts movement of the upper limit protrusion 67. The inclined portion is formed under the upper limit protrusion guide channel to be narrowed downward for guiding the latching protrusion 65 of the spool to a direction. The latching protrusion guide channel is extended downward under the inclined portion for guiding movement of the inclined latching protrusion 65. The fixing hollow 73 is formed laterally at a lower end of the latching protrusion guide channel for interposing the latching protrusion of the spool therein.

Figure 12:
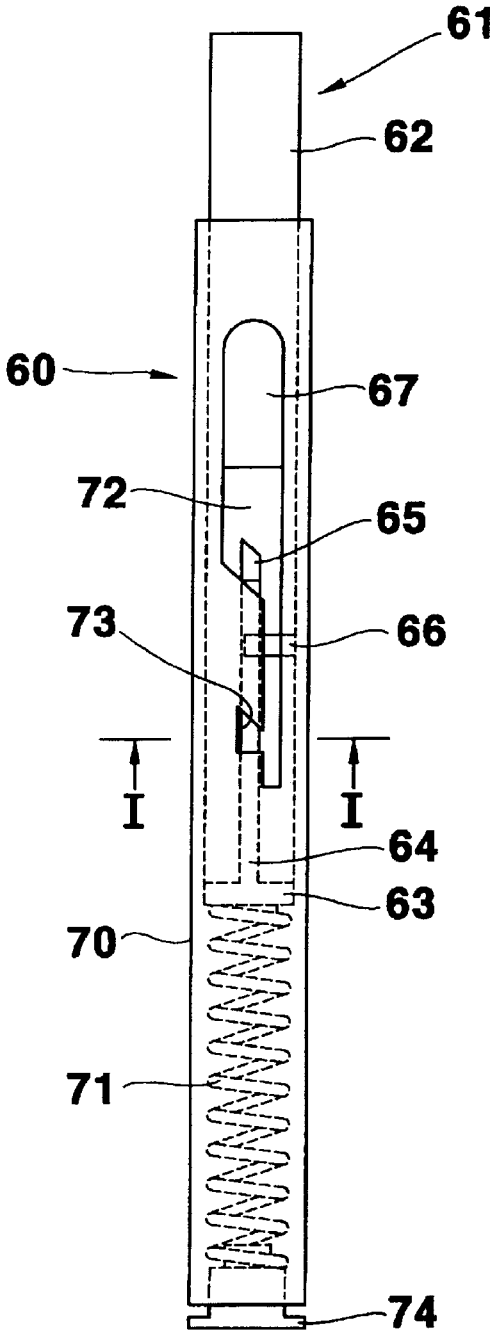
FIG. 12 is a front view showing that the spool rises along a guide channel of the spool guide to an upper limit and stops at the upper limit.

When opening the floor F', the spool 61 rises in and along the guide channel 72 and stops when the upper limit protrusion 67 meets an upper end of the guide channel 72 (see FIG. 12). In addition, when the spool is in its lowest position, the upper end of the latching protrusion 65 is fit with the fixing hollow 73, so fixing the spool (see FIG. 11).

Now, operation of the floor F' of the present invention as constructed above is explained referring to the accompanying drawings.

When opening the floor body plate 40 for repair or maintenance in a closed state of the floor F', a worker or a manager at first moves the locking pin 42 to the release position. Then, the second portion end of the locking pin 42 upon the upper limit protrusion 67 is rotated counterclockwise on the pivot. The second portion end of the locking pin 42 then escapes from the upper limit protrusion 67 with slightly pushing the upper limit protrusion 67 downward.

When the upper limit protrusion 67 is pushed downward, the latching protrusion 65 of the spool 61 is correspondingly moved downward. The downwardly moving latching protrusion 65 is moved toward the spool body 62 while the inclined outer surface of the latching protrusion 65 is sliding on a lower side of the fixing hollow 73. At the same time, the elastic bar 64 is moved laterally along the inclined side surface of the elastic bar guide protrusion 66, resulting that the latching protrusion 65 escapes from the fixing hollow 73 of the spool guide 70.

Figure 13:
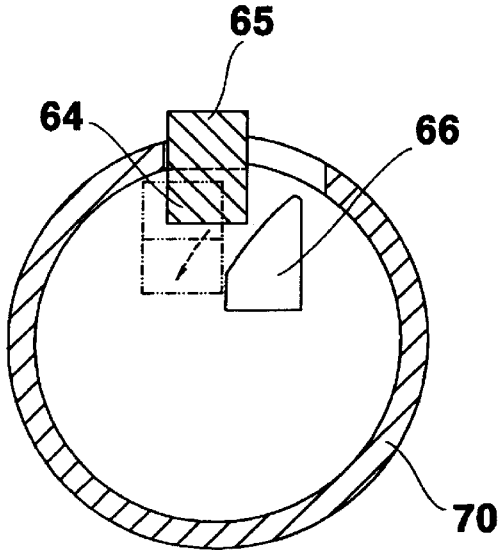
FIG. 13 is a schematic view, taken by an I—I line in FIG. 12, for illustrating how the latching protrusion escapes from the fixing hollow.

Referring to FIG. 13, the above operation is described again, in detail. When the floor F' is closed at first, the latching protrusion 65 is within the fixing hollow 73 of the spool guide 70, which is expressed in a solid line in the corresponding figure. After that, when moving the locking pin 42 to the release position, with the spool 61 moving downward, the latching protrusion 65 is pulled inward, that is, toward center of the spool guide 70, so that the elastic bar 64 moves correspondingly. The elastic bar 64, pulled inward, is then slid and pushed laterally by the elastic bar guide protrusion 66, thus escaping from the fixing hollow 73. The latching protrusion 65 pushed laterally is shown together with the elastic bar 64 in a dotted line in the figure. Once escaping from the fixing hollow 73, the latching protrusion 65 does not return to the fixing hollow 73 by means of the elastic bar guide protrusion 66 and the spool guide 70. After that, when the spool 60 rises, the elastic bar 64 moves with being pushed by the latching protrusion 65 as described above.

Referring to FIGS. 4 and 11 again when the floor F' is closed, the spool 61 is fixed in a state of compressing the spring 71 with being locked by the locking pin 42. However, when releasing the locking pin 42 as shown in FIG. 6, the latching protrusion 65 of the spool 61 escapes from the fixing hollow 73 of the spool guide 70 which the spool 61 moves upward by the restoring force of the spring 71. The spool 61 rises until the upper limit protrusion 67 reaches the upper end of the guide channel 72 of the spool guide 70.

Referring to FIG. 6, while the spool 61 moves upward, the spool body 62 pushes the one end bottom of the floor body plate 40 upward in correspondence with the spool 61. At this time, in the fact that the floor roller 41 is retained in a fixed height and allowed only a forward and rear movement, the floor body plate 40 is inclined with its end near the lift 60 being ascended. After that, when a worker or a manager pulls the inclined floor body plate 40 against the lift 60, the rollers 41 mounted on bottom of the body plate move along the floor roller guide rail 51, so opening the floor F'. When the rollers approach the lift 60, the manager makes the floor body plate 40 stand upright, and then fixes it with the hook 52.

On the other hand, closing the floor body plate 40 requires an inverse operation to the described opening operation. At first, a manager or a worker releases the hook 52 from the floor body plate 40. Then, the manager pushes a lower portion of the floor body plate 40 opposite to the lift 60. The floor rollers 41 of the body plate 40 then move along the guide rails 51, so the body plate 40 being inclined to its partly opened state shown in FIG. 6. The worker or the manager then presses downward the floor body plate 70 at its end portion supported by the spool 61. Then, the spool 61 moves downwardly with compressing the spring 71.

When the spool 61 moves downwardly, the latching protrusion 65 of the spool 61 moves along the guide channel 72. That is, the latching protrusion 65 moves from a broad portion to a narrow portion of the guide channel 72, such that the elastic bar 64 moves with being slightly inclined laterally. Then the latching protrusion 65 reaches near the fixing hollow 73, the latching protrusion 65 enters the fixing hollow 73 by the restoring force of the elastic bar 64. Therefore, the latching protrusion 65 is fixed by the fixing hollow 73, so completing the closing operation of the floor F'. As a result, the floor body plate 40 then retains its horizontal relation.

Under this circumference, the floor body plate 40 is not abruptly opened by any external impact or pressure when returning the locking pin 42 to its original locking position.

The floor F' for the passenger conveyor according to the present invention as constructed above is very convenient because the floor F' can be opened by manipulating only the locking pin 42 of the floor body plate 40 without any other instrument. In addition, because the spool 61 of the lift 60 pushes the one end bottom of the floor body plate 40 upward by the simple manipulation of the locking pin 42, the floor F' can be advantageously opened by only one person.

Moreover, the present invention does not demand any extra space for storing the body plate 40 owing that the floor body plate 40 can stand and be fixed upright after moving along the floor roller guide rail 51, so enhancing efficiency of working. Besides, due to its improved safety around the working spot, there is no need to install an extra safety fence. Additionally, the present invention can prevent the floor body plate 40 from being contaminated and damaged.

Although the present invention has been described in considerable detail with reference to certain preferred embodiments thereof, other variations and modifications are possible.

Therefore, the spirit and scope of the appended claims should not be limited to the description of the preferred embodiments contained herein.

What is claimed is:

1. A passenger conveyor comprising, a plurality of steps for providing space for passenger to board on;

floors disposed in starting and ending portions of the steps for serving as supports for the passengers getting on or off the steps;

machine rooms disposed below the floors; and lift means installed in the machine room for lifting the floor.

2. The passenger conveyor as claimed in claim 1, wherein the lift means comprises, a spool for supporting one end bottom of the floor;

a spool guide mounted around the spool for guiding the spool vertically;

an elastic member installed below the spool guide for providing elastic force such that the spool moves upward; and a locking pin pivotably mounted in an upper and outer position of the spool guide, the locking pin being rotatable to a locking position or a release position in order to lock or release the spool.

3. The passenger conveyor as claimed in claim 2, wherein the spool comprises, a spool body having a predetermined length;

a spring seat formed on a lower end of the spool body for supporting one end of the elastic member;

an elastic bar integrated with the spool body and extended from the spring seat upwardly in parallel with the spool body;

a latching protrusion protruding opposite to the spool body from an upper end of the elastic bar;

an elastic bar guide protrusion formed on a side of the spool body and protruding against the elastic bar for guiding and converting direction of the elastic bar when the elastic bar is pushed inward by the spool guide; and an upper limit protrusion protrusively formed at an upper portion of the spool body, a thickness of the upper limit protrusion gradually decreasing from top to bottom, the upper limit protrusion having a curved upper surface.

4. The passenger conveyor as claimed in claim 2, wherein the spool guide comprises, a spool guide body for receiving the spool;

a spring seat fitted into a lower end of the spool guide body;

an upper limit protrusion guide channel formed at an upper outer circumference of the spool guide body vertically for guiding and restricting movement of the upper limit protrusion;

an inclined portion formed under the upper limit protrusion guide channel to be narrowed downwardly for guiding the latching protrusion of the spool to a direction;

a latching protrusion guide channel extended vertically and downwardly under the inclined portion for guiding movement of the inclined latching protrusion; and a fixing hollow formed laterally at an lower end of the latching protrusion guide channel for interposing the latching protrusion of the spool therein by the restoring force of the elastic bar.

5. The passenger conveyor as claimed in claim 2, wherein the elastic member is interposed between the spring seat of the spool and the spring seat of the spool guide for providing the elastic force against the spool.

6. The passenger conveyor as claimed in claim 2, wherein the locking pin comprises, a rotary axis rotatably fixed by a pivot;

a first portion extending from the rotary axis toward the floor; and a second portion extending from the rotary axis toward the upper limit protrusion of the spool, the second portion of the locking pin being at a predetermined angle with the first portion.

7. A passenger conveyor comprising, a plurality of steps for providing space for passenger to board on;

floors disposed in starting and ending portions of the steps for serving as supports for the passengers getting on or off the steps;

machine rooms disposed below the floors;

floor rollers rotatably mounted in both side ends of a bottom of the floor; and floor roller guide rails mounted in both sides upon the machine room for guiding the floor rollers.

8. The passenger conveyor as claimed in claim 7, further comprising a hook rotatably mounted at an upper side of the machine room for fixing the floor when opening the floor.

9. A passenger conveyor comprising, a plurality of steps for providing space for passenger to board on;

floors disposed in starting and ending portions of the steps for serving as supports for the passengers getting on or off the steps;

machine rooms disposed below the floors;

lift means installed in the machine room to be in contact with a bottom of the floor for lifting the floor;

floor rollers rotatably mounted in both side ends of a bottom of the floor; and floor roller guide rails mounted in both sides upon the machine room for guiding the floor rollers.

10. The passenger conveyor as claimed in claim 9, wherein the lift means comprises, a spool for supporting one end bottom of the floor;

a spool guide mounted around the spool for guiding the spool vertically;

an elastic member installed below the spool guide for providing elastic force such that the spool moves upward; and a locking pin pivotably mounted in an upper and outer position of the spool guide, the locking pin being rotatable to a locking position and a release position in order to locking or releasing the spool.

11. The passenger conveyor as claimed in claim 10, wherein the spool comprises, a spool body having a predetermined length;

a spring seat formed on a lower end of the spool body for supporting one end of the elastic member;

an elastic bar integrated with the spool body and extended from the spring seat upwardly in parallel with the spool body;

a latching protrusion protruding opposite to the spool body from an upper end of the elastic bar;

an elastic bar guide protrusion formed on a side of the spool body and protruding against the elastic bar for guiding and converting direction of the elastic bar when the elastic bar is pushed inward by the spool guide; and an upper limit protrusion protrusively formed at an upper portion of the spool body, a thickness of the upper limit protrusion gradually decreasing from top to bottom, the upper limit protrusion having a curved upper surface.

12. The passenger conveyor as claimed in claim 10, wherein the spool guide comprises, a spool guide body for receiving the spool;

a spring seat fitted into a lower end of the spool guide body;

an upper limit protrusion guide channel formed at an upper outer circumference of the spool guide body vertically for guiding and restricting movement of the upper limit protrusion;

an inclined portion formed under the upper limit protrusion guide channel to be narrowed downwardly for guiding the latching protrusion of the spool to a direction;

a latching protrusion guide channel extended vertically and downwardly under the inclined portion for guiding movement of the inclined latching protrusion; and a fixing hollow formed laterally at an lower end of the latching protrusion guide channel for interposing the latching protrusion of the spool therein by the restoring force of the elastic bar.

13. The passenger conveyor as claimed in claim 10, wherein the elastic member is interposed between the spring seat of the spool and the spring seat of the spool guide for providing the elastic force against the spool.

14. The passenger conveyor as claimed in claim 10, wherein the locking pin comprises, a rotary axis rotatably fixed by a pivot;

a first portion extending from the rotary axis toward the floor; and a second portion extending from the rotary axis toward the upper limit protrusion of the spool, the second portion of the locking pin being at a predetermined angle with the first portion.

15. The passenger conveyor as claimed in claim 9, further comprising a hook rotatably mounted at an upper side of the machine room for fixing the floor when opening the floor.

* * * * *